US012448810B1

(12) United States Patent
Peer

(10) Patent No.: US 12,448,810 B1
(45) Date of Patent: Oct. 21, 2025

(54) FENCE SYSTEM

(71) Applicant: Shilo Peer, Artesian, SD (US)

(72) Inventor: Shilo Peer, Artesian, SD (US)

( * ) Notice: Subject to any disclaimer, the term of this patent is extended or adjusted under 35 U.S.C. 154(b) by 275 days.

(21) Appl. No.: 18/372,254

(22) Filed: Sep. 25, 2023

(51) Int. Cl.
*E04H 17/14* (2006.01)
*E04H 17/20* (2006.01)

(52) U.S. Cl.
CPC ..... *E04H 17/1465* (2021.01); *E04H 17/21* (2021.01)

(58) Field of Classification Search
None
See application file for complete search history.

(56) References Cited

U.S. PATENT DOCUMENTS 4,149,701 A * 4/1979 Densen ..... F16B 9/058 403/174
4,188,019 A * 2/1980 Meredith ..... E04F 11/181 256/73
6,299,142 B1 * 10/2001 Chaney ..... E04H 17/1439 256/19
8,646,756 B2 * 2/2014 Mann ..... E06B 11/02 256/73
8,777,186 B2 * 7/2014 Russier ..... E04H 17/1465 256/65.03
8,960,647 B2 * 2/2015 Wallace ..... E01F 15/0461 404/6
2006/0086930 A1 * 4/2006 Esposito ..... E04H 17/1447 256/65.11

* cited by examiner

*Primary Examiner* — Daniel J Wiley
(74) *Attorney, Agent, or Firm* — Jeffrey A. Proehl; Woods Fuller Shultz & Smith P.C.

(57) ABSTRACT

A fence system may include a post and a rail for extending from the post. The post may be elongated along a longitudinal axis and have opposite ends. The post may be at least partially tubular with a perimeter wall extending about a substantially hollow interior. The post may have a rail aperture for receiving an end portion of the rail. The rail aperture may be defined by an aperture edge of the perimeter wall, and the aperture edge may have a main portion. The rail aperture may have a securing tab protruding from the main portion of the aperture edge. The securing tab may be defined by a tab portion of the aperture edge. The securing tab may be deflectable from an undeflected condition to a deflected condition.

16 Claims, 3 Drawing Sheets

FENCE SYSTEM

BACKGROUND

Field

The present disclosure relates to fences and more particularly pertains to a new fence system which may provide advantages in formation of the component parts of the fence system and in the assembly of the component parts to form a fence.

SUMMARY

In some aspects, the present disclosure relates to a fence system that may comprise at least one post for extending upwardly from a foundational surface. The at least one post may be elongated along a longitudinal axis and have opposite ends defining a length of the post. A first end of the opposite ends may be for positioning above the surface and a second end of the opposite ends may be for positioning at or below the surface. The at least one post may be at least partially tubular in character with a perimeter wall extending about a substantially hollow interior of the post. The system may also comprise at least one rail for extending from the at least one post, with a portion of the rail being positionable in the interior of the at least one post. The at least one rail may be elongated with opposite end portions and a peripheral surface. The at least one post may have a rail aperture which is configured to receive a portion of the at least one rail thereinto. The rail aperture may be defined by an aperture edge of the perimeter wall, and the aperture edge may have a main portion. The rail aperture may have a securing tab, and the aperture edge of the rail aperture may define the securing tab. The securing tab may protrude from the main portion of the aperture edge, and the securing tab may be elongated with a base end and a free end. The securing tab may be defined by a tab portion of the aperture edge. The securing tab may be deflectable from an undeflected condition to a deflected condition, with the deflected condition being characterized by a portion of the securing tab being oriented at an angle of approximately 90 degrees with respect to the undeflected condition.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
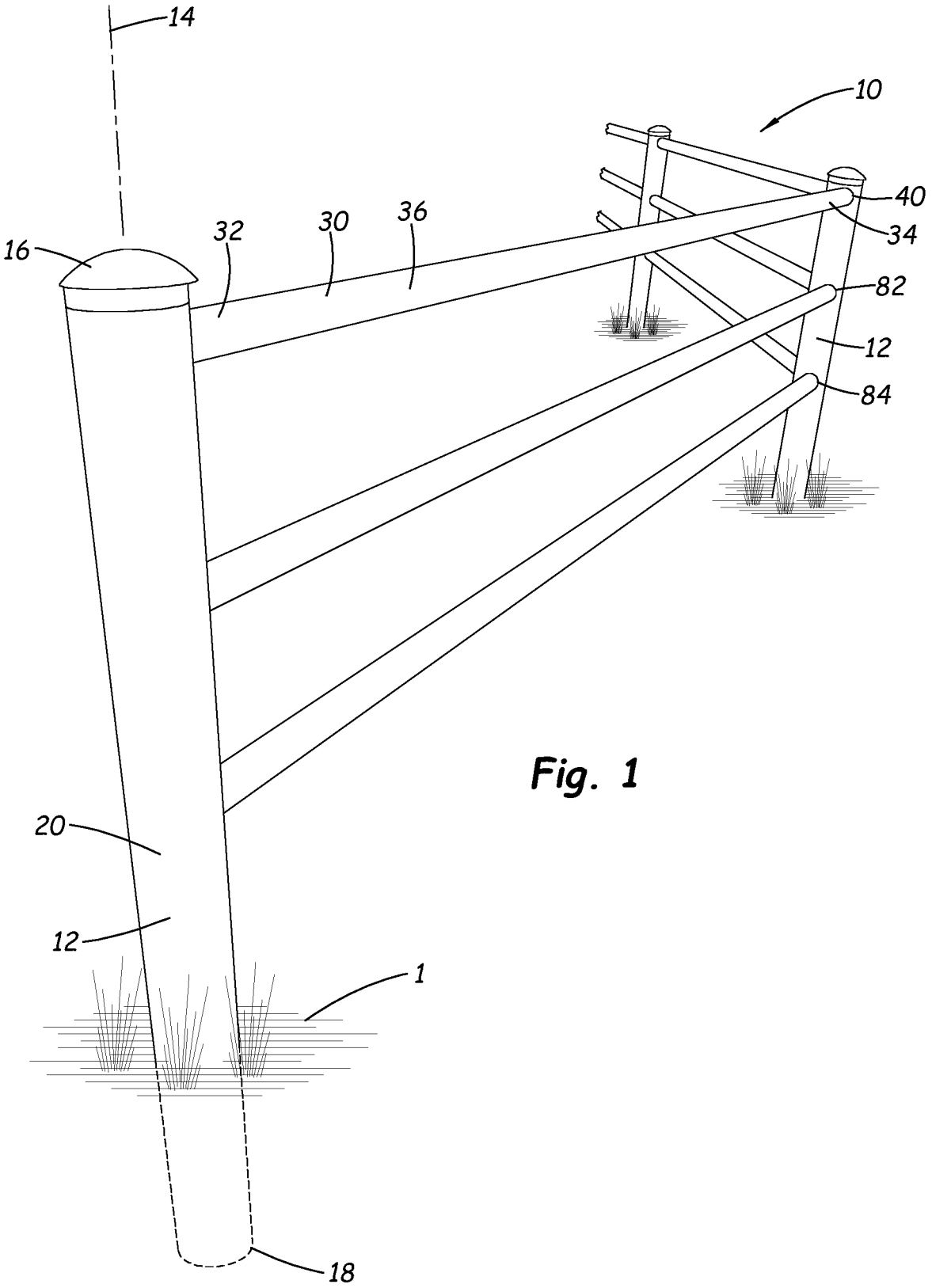
FIG. 1 is a schematic perspective view of an illustrative installation of a new fence system according to the present disclosure.
Figure 2:
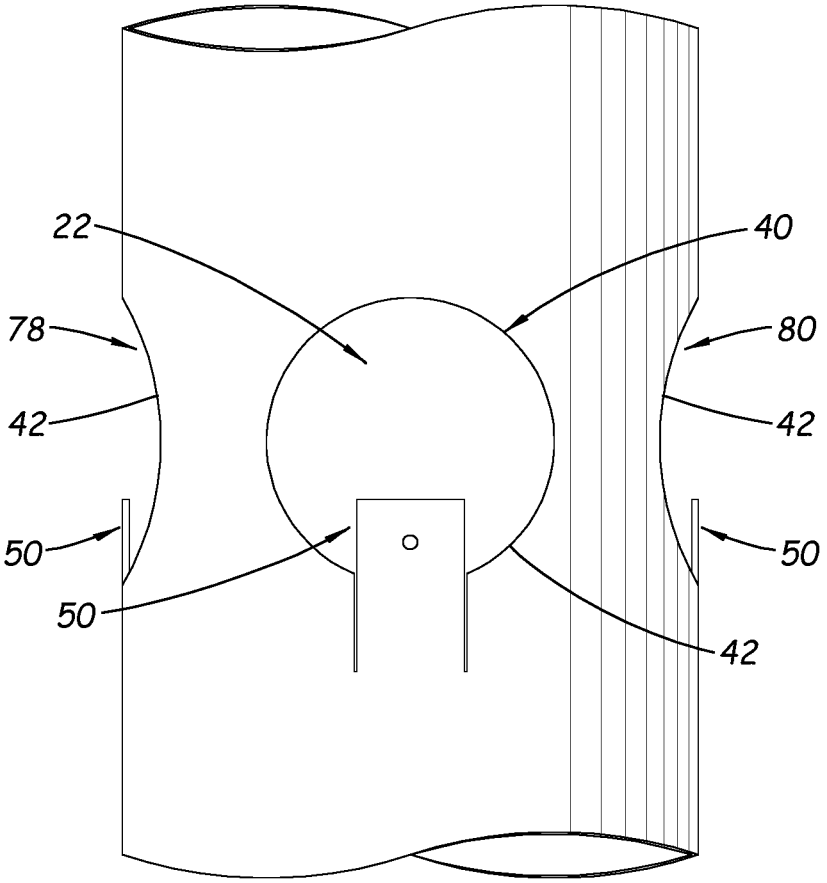
FIG. 2 is a schematic side elevational view of a portion of a fence post of the fence system, according to an illustrative embodiment.
Figure 3:
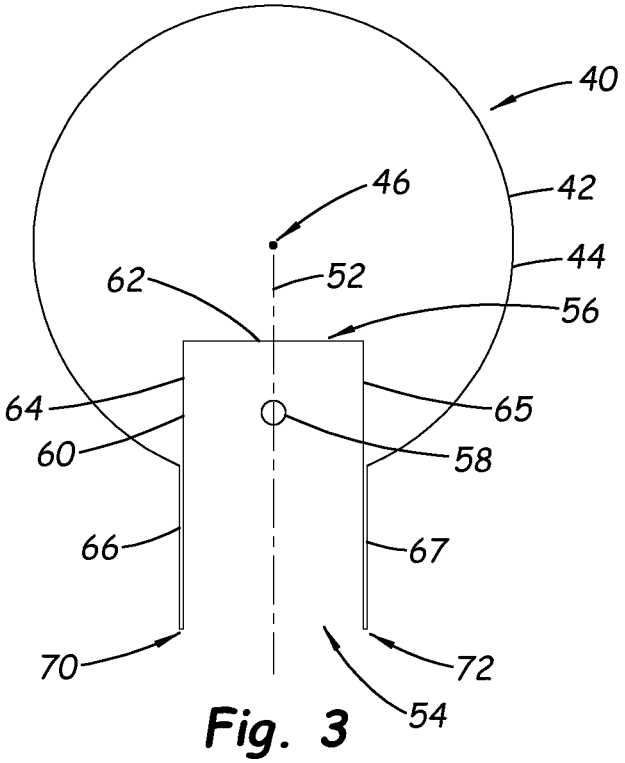
FIG. 3 is a schematic side elevational view of a rail aperture of the fence post, according to an illustrative embodiment.

With reference now to the drawings, and in particular to FIGS. 1 through 4 thereof, a new fence system embodying the principles and concepts of the disclosed subject matter will be described.

The applicant has recognized that the ability to create a secure attachment of a fence rail to a fence post is highly desirable in a fence system, while also recognizing that the ability to relatively easily cut a fence rail to length in the field is also desirable as it adds to the convenience and accuracy of installation. Moreover, fence systems in which specialized structures are required on the ends of the fence rail tend to complicate the task of fence installation by making it more difficult, if not impossible, to cut the fence rail to the needed length measured there in the field.

The applicant has devised a fence system that creates a secure attachment of a fence rail to a fence post without requiring any specialized structure on the ends of the fence rail, and as a result the rail can be cut to an appropriate length in the field and assembled to the post without having to fabricate the rail at a specific length in a production facility.

Further, the applicant has devised a fence system which readily permits connection of a fence rail to a fence post in a configuration in which the axis of the rail at a wide variety of angles in a horizontal plane substantially parallel to the ground surface. Moreover, while an end portion of the fence rail is inserted into an aperture in the fence post, the axis of the rail is not required to be parallel to the axis of the aperture extending into the post. Further, for most angles, there is no need to cut the end of the rail at a specialized angle with respect to the axis of the rail in order to accommodate the angular relationship between the rail to the fence post. In some highly advantageous embodiments, a securing tab may be formed integrally with the fence post that functions to secure the rail in the aperture of the post.

A fence system 10 may be used to fence in or enclose an area of land surface and may have a length across the ground surface that is variable by including additional elements of the fence system in a fence installation. Typically, the path of the fence installation is linear and straight with perpendicular turns at corners of the installation. However, turns or variations in the path of less or greater than 90 degrees are possible with the system.

In general, the fence system 10 may include at least one post 12 and at least one rail 30 mounted on the post as a basic unit of a fence installation, with as many or as few units needed to extend along the desired path. Each unit may include one, two, three or more rails extending between a pair of the posts.

In greater detail, the fence post 12 of the system may be utilized for extending upwardly from a foundational surface 1, and typically the surface 1 comprises the ground surface such as, for example, in a field. The post 12 may be partially inserted into the foundational surface so that a portion of the post is positioned within the ground to provide foundational support for the post, and the remaining portion of the post 12 protrudes upwardly from the surface 1. The post 12 is elongated along a longitudinal axis 14, and when installed, the axis 14 is typically oriented substantially perpendicular to the foundational surface. The elongated post 12 has opposite ends 16, 18 which define a length of the post, with a first one 16 of the ends being positionable above the surface 1 and a second one 18 of the ends being positionable at or below the surface 1.

The fence post 12 may be tubular in character between the opposite ends 16, 18, and may comprise a perimeter wall 20 which may extend between the ends of the post. The perimeter wall 20 may extend about a substantially hollow interior 22 of the post, and illustratively may be formed of a sheet material formed of, for example, a metal such as steel. The perimeter wall 20 may be continuous about a perimeter located in a plane oriented perpendicular to the longitudinal axis 14. In the illustrative embodiments, the perimeter wall 20 has a substantially circular shape in the perpendicular plane, but other suitable embodiments may have other cross-sectional shapes, including shapes that are polygonal (e.g., substantially rectangular) or irregular. The perimeter wall 20 may have an upper opening into the interior at the first end 16 and a lower opening into the interior at the second end 18.

The fence rail 30 may extend from the fence post 12 in an installation of the fence system, and may extend between adjacent posts in an array of the posts arranged along the path of the fence. A portion of the rail 30 may be insertable into, and positionable in, the interior 22 of the post to which the rail is attached. The rail 30 is elongated with opposite end portions 32, 34. The rail 30 has a peripheral surface 36 which has a shape in a plane perpendicular to the length of the rail. In the illustrative embodiments, the shape of the peripheral surface 36 is substantially circular, but in other embodiments the shape may be polygonal, such as, for example, substantially rectangular, or irregular.

A significant feature of the post 12 or posts of the system 10 is a rail aperture 40 which is configured to receive a portion (such as an end portion) of a rail 30 to be supported by the post. The rail aperture 40 may be defined on the post by an aperture edge 42 of the perimeter wall. The aperture edge 42 may be formed by severing material of the perimeter wall 20 from a remainder of the perimeter wall such that the edge 42 is formed by material remaining on the post after the severed material is removed from the remaining material of the perimeter wall. The aperture edge 42 may be continuous about the opening formed in the post by the rail aperture. The aperture edge 42 may have a primary extent or main portion 44, and in general the main portion of the aperture edge may have a shape that substantially corresponds to the shape of the peripheral surface 36 of the rail which is to be attached to the post. The main portion 44 of the aperture edge may have a size that substantially corresponds to a size of the peripheral surface of the rail, and in the illustrative embodiments, the main portion of the edge is substantially circular in shape. The rail aperture 40 may have a center 46 which may be substantially equidistant from sections of the main portion of the rail aperture.

A further significant feature of the fence rail is a securing tab 50 which forms a part of the rail aperture 40. In general, the securing tab 50 extends into the rail aperture, and may extend toward the center 46 of the aperture. Advantageously, embodiments of the securing tab 50 are integrally formed with the post 12, and more specifically the perimeter wall 20 of the post. The securing tab 50 may protrude from the main portion 44 of the aperture edge, and may be elongated along a tab axis 52. The tab axis 52 may substantially intersect with the center 46 of the main portion of the aperture. The axis 52 may extend between a base end 54 and a free end 56 of the tab 50. The securing tab 50 may have a securing hole 58 formed therein for receiving a fastener 59 to fasten the securing tab to the rail.

The securing tab 50 may be defined by a tab portion 60 of the aperture edge 42. In the illustrative embodiments of the securing tab 50, the tab portion 60 of the aperture edge may include a number of sections. One section of the tab portion may be an end section 62, and illustratively the end section may be substantially straight in character to produce a blunt free end 56 of the tab. Other sections of the tab portion may include a pair of side sections 64, 65 which may extend from the end section 62 toward the main portion 44 of the aperture edge. The pair of side sections 64, 65 may be oriented substantially parallel to each other, and also may be oriented substantially perpendicular to the end section. Yet another section of the tab portion may include an extension section 66 which extends beyond the main portion of the aperture edge, and may include a pair of the extension section 66, 67 which each extend from a respective one of the side sections 64, 65 and thus form an extension of the respective side section. The extension sections 66, 67 may be oriented substantially parallel to each other, and each extension section may form a respective slot 70, 72 with the pair of slots being located on opposite sides of the securing tab 50.

The securing tab 50 has an inner surface 74 and an outer surface 76, with the inner surface being oriented toward the interior 22 of the post and the outer surface being oriented away from the interior. In the illustrative embodiments, the inner surface 74 may be generally concave in contour, and the outer surface 76 may be generally convex in contour, and the contours may generally correspond to the shape of the material of the perimeter wall 20 forming the tab 50.

Figure 4:
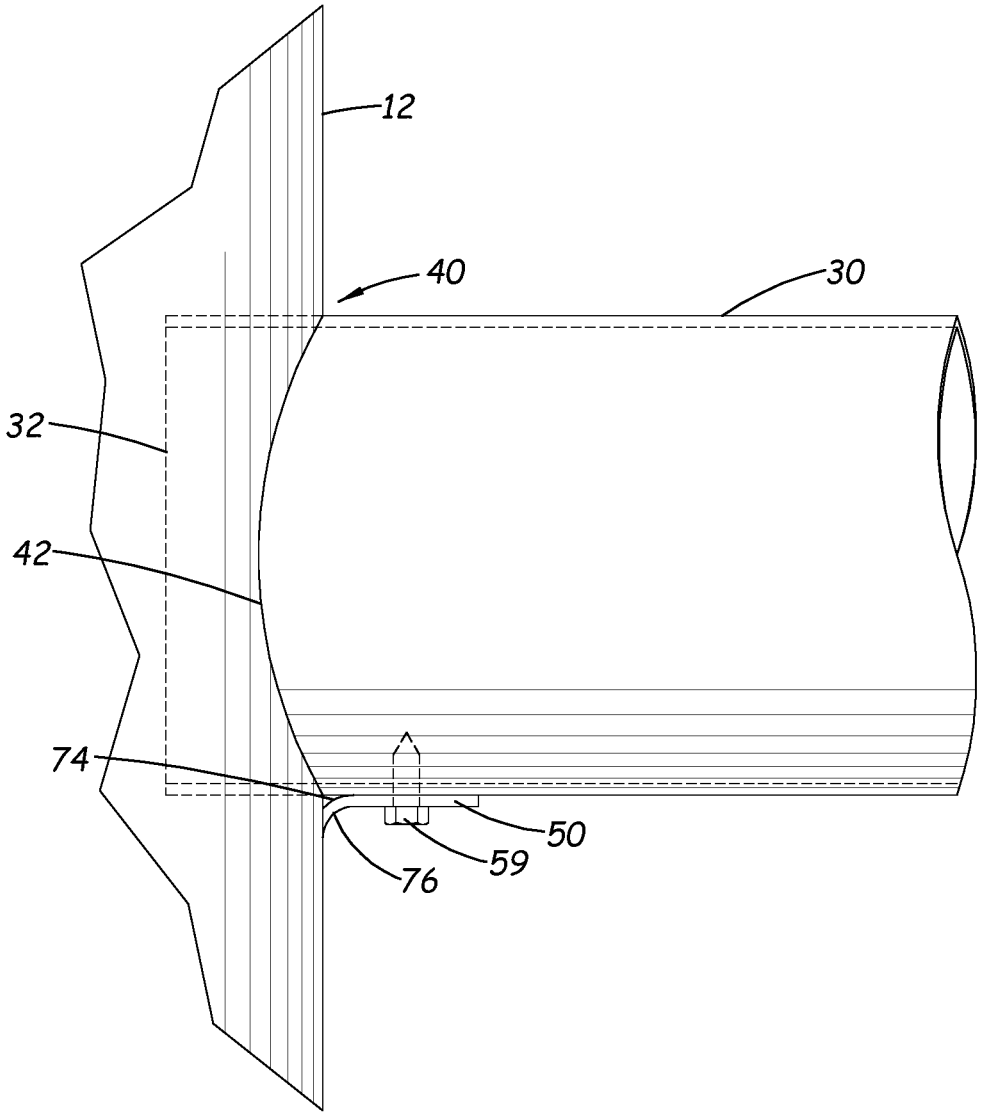
FIG. 4 is a schematic side view of attached portions of a fence post and a fence rail of the fence system, according to an illustrative embodiment.

Advantageously, the securing tab 50 may be deflectable or bendable from an undeflected condition (see FIGS. 2 and 3) to a deflected condition (see FIG. 4). The undeflected condition may generally be the condition of the securing tab after a portion of the perimeter wall has been severed from the remaining perimeter wall to form the aperture 40. The deflected condition of the securing tab 50 may be characterized by a portion of the tab being oriented at an angle of approximately 90 degrees with respect to the undeflected condition of the tab. When the fence post is installed in the ground surface, the deflected condition of the tab may be characterized by the concave inner surface 74 being oriented upwardly for contacting the peripheral surface 36 of the rail in a supportive manner, with a portion of the rail 30 resting upon the inner surface of the tab. The fastener 59 may be inserted in an upward direction through the securing hole 58 and passed into a portion of the perimeter wall 20 of the rail to secure the rail to the tab, and by extension, the post. Thus, the rail 30 is attached to the post by insertion of an end portion of the rail into the rail aperture and by the fastener 59 securing the rail to the securing tab 50. Advantageously, the undeflected condition of the securing tab 50 does not interfere with stacking and movement of the fence post 12 prior to the assembly and installation of the fence system, and may be simply and easily moved to the deflected condition utilizing tools readily available (such as a pliers) when securement of the tab to the rail is desired.

Each of the fence post 12 may have a plurality of the rail apertures formed therein. The rail apertures may include a first group of rail apertures 40, 78, 80, which may be located at a substantially similar distance from one of the opposite ends 16, 18 of the post. Some of the rail apertures of the first group, such as rail apertures 40 and 78, may extend into the post along parallel axes such that the apertures 40, 78 are located on opposite lateral sides of the post. Illustratively, the rail apertures 40 and 78 may extend along substantially colinear axes. Another aperture 80 of the first group of rail apertures may extend into the post 12 along an axis oriented perpendicular to other apertures, such as apertures 40 and 78, to accommodate a rail to be attached to the post at an angle generally exceeding the range of angles suitable to be accommodated by one of the apertures 40 and 78. The plurality of rail apertures may additionally include a second group of rail apertures 82, 84. The rail apertures of the second group may be located at a different distance from one of the opposite ends of the post than characterizes the apertures of the first group.

It should be appreciated that in the foregoing description and appended claims, that the terms "substantially" and "approximately," when used to modify another term, mean "for the most part" or "being largely but not wholly or completely that which is specified" by the modified term, and may be further quantified as values or qualities which deviate approximately 10 percent or less from the value or quality or relationship stated in the disclosure.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A fence system comprising:

at least one post for extending upwardly from a foundational surface, the at least one post being elongated along a longitudinal axis, the at least one post having opposite ends defining a length of the at least one post, a first end of the opposite ends being for positioning above the surface and a second end of the opposite ends being for positioning at or below the surface, the at least one post being at least partially tubular in character with a perimeter wall, extending about a substantially hollow interior of the post;

at least one rail for extending from the at least one post, a portion of the rail being positionable in the interior of the at least one post, the at least one rail being elongated with opposite end portions, the at least one rail having a peripheral surface;

wherein the at least one post has a rail aperture configured to receive a portion of the at least one rail thereinto, the rail aperture being defined by an aperture edge of the perimeter wall, the aperture edge having a main portion;

wherein the rail aperture has a securing tab, the aperture edge of the rail aperture defining the securing tab, the securing tab protruding from the main portion of the aperture edge, the securing tab being elongated with a base end and a free end, the securing tab being defined by a tab portion of the aperture edge, wherein the tab portion include at least one extension section extending longitudinally away from the main portion of the aperture edge; and wherein the securing tab is deflectable from an undeflected condition to a deflected condition, the deflected condition being characterized by a portion of the securing tab being deflected along the extension section and oriented at an angle of approximately 90 degrees with respect to the undeflected condition.

2. The fence system of claim 1 wherein the perimeter wall is formed of a sheet material, the perimeter wall being continuous about a perimeter in a plane oriented perpendicular to the longitudinal axis of the at least one post.

3. The fence system of claim 1 wherein the aperture edge of the at least one post is of the type formed by severing material of the perimeter wall from the perimeter wall such that the edge is formed by material of the perimeter wall remaining with the at least one post.

4. The fence system of claim 1 wherein the aperture edge is continuous about the rail aperture.

5. The fence system of claim 1 wherein the main portion of the aperture edge has a shape substantially corresponding to a shape of the peripheral surface of the at least one rail.

6. The fence system of claim 1 wherein the main portion of the aperture edge has a size substantially corresponding to a size of the peripheral surface of the at least one rail.

7. The fence system of claim 6 wherein the main portion of the aperture edge is substantially circular in shape.

8. The fence system of claim 1 wherein the rail aperture has a center, the securing tab extending toward the center of the rail aperture.

9. The fence system of claim 8 wherein the securing tab is elongated along a tab axis that substantially intersects the center of the rail aperture.

10. The fence system of claim 1 wherein the securing tab has a securing hole for receiving a fastener to fasten the securing tab to the at least one rail.

11. The fence system of claim 1 wherein the securing tab has an inner surface oriented toward the interior of the at least one post and an outer surface oriented away from the interior of the at least one post, the inner surface being concave and the outer surface being convex.

12. The fence system of claim 1 wherein the tab portion of the aperture edge includes:

an end section at the free end of the securing tab; and a pair of side sections extending from the end section toward the main portion of the aperture edge;

wherein the extension section is an extension of one of the side sections of the tab portion of the aperture edge and forming a slot located on a side of the securing tab.

13. The fence system of claim 1 wherein the at least one post has a plurality of rail apertures including a first group of rail apertures, the rail apertures of the first group each being located at substantially the same distance from one of the opposite ends of the at least one post.

14. The fence system of claim 13 wherein a pair of the rail apertures of the first group extend into the at least one post along parallel axes.

15. The fence system of claim 14 wherein the pair of the rail apertures of the first group extend into the at least one post along axes oriented perpendicular to each other.

16. The fence system of claim 13 wherein a second group of rail apertures are located at different distances from one of the opposite ends of the at least one post.

* * * * *